US009898956B2

(12) United States Patent
Kuo et al.

(10) Patent No.: US 9,898,956 B2
(45) Date of Patent: Feb. 20, 2018

(54) METHOD OF DRIVING ACTIVE-MATRIX ORGANIC LIGHT-EMITTING DIODE (AMOLED) PANELS

(71) Applicant: Shenzhen China Star Optoelectronics Technology Co., Ltd., Shenzhen, Guangdong (CN)

(72) Inventors: Ping-sheng Kuo, Guangdong (CN); Li-wei Chu, Guangdong (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 150 days.

(21) Appl. No.: 14/765,108

(22) PCT Filed: Mar. 20, 2015

(86) PCT No.: PCT/CN2015/074680

§ 371 (c)(1),
(2) Date: Jul. 31, 2015

(87) PCT Pub. No.: WO2016/138678

PCT Pub. Date: Sep. 9, 2016

(65) Prior Publication Data

US 2016/0307491 A1 Oct. 20, 2016

(30) Foreign Application Priority Data

Mar. 3, 2015 (CN) ..... 2015 1 0095621

(51) Int. Cl.
*G09G 3/20* (2006.01)
*G09G 3/3225* (2016.01)

(52) U.S. Cl.
CPC ..... *G09G 3/2025* (2013.01); *G09G 3/2022* (2013.01); *G09G 3/3225* (2013.01);
(Continued)

(58) Field of Classification Search
CPC .. G09G 3/00; G09G 3/20; G09G 3/28; G09G 3/2025; G09G 3/3225; G09G 3/2022; G09G 2320/0266; G09G 2330/021
See application file for complete search history.

(56) References Cited

U.S. PATENT DOCUMENTS

2005/0104812 A1* 5/2005 Ohshima ..... G09G 3/2022 345/60
2006/0232600 A1* 10/2006 Kimura ..... G09G 3/32 345/605

(Continued)

FOREIGN PATENT DOCUMENTS

CN 1692393 A 11/2005

*Primary Examiner* — Lun-Yi Lao
*Assistant Examiner* — Johny Lau
(74) *Attorney, Agent, or Firm* — Andrew C. Cheng

(57) ABSTRACT

A method of driving active-matrix organic light-emitting diode (AMOLED) panels includes: (A) dividing a current frame of a current image corresponding to an i-th color component into a plurality of sub-frames, wherein i∈[1,N], and N is a total number of the color component; (B) obtaining a sequence of the sub-frames of a previous frame of a previous image corresponding to the i-th color component, wherein the previous frame has been divided into a plurality of sub-frames by the same way with the current frame; (C) determining the sequence of the sub-frames of the current frame in accordance with the sequence of the sub-frames of the previous frame, wherein the sequence of the sub-frames (SF) of the current image is same with or is different from that of the previous frame; and (D) controlling the panel to display in accordance with the sequence of the sub-frames of the current frame determined by corresponding color components.

6 Claims, 7 Drawing Sheets

(52) U.S. Cl.
CPC ..... *G09G 2320/0266* (2013.01); *G09G 2330/021* (2013.01)

(56) References Cited

U.S. PATENT DOCUMENTS

2014/0240366 A1* 8/2014 Lee ..... G09G 3/2033 345/690
2014/0313245 A1* 10/2014 Park ..... G09G 3/2033 345/694

* cited by examiner

METHOD OF DRIVING ACTIVE-MATRIX ORGANIC LIGHT-EMITTING DIODE (AMOLED) PANELS

BACKGROUND OF THE INVENTION

1. Field of the Invention

The present disclosure relates to a driving method of display panels, and more particularly to a driving method of AMOLED panels.

2. Discussion of the Related Art

AMOLED panels are characterized by attributes, such as fast response time, high contrastness, and wide viewing angles, and thus have been greatly adopted in portable devices, such as cellular phones and tables, and televisions, personal computers having display devices.

Currently, the AMOLED panels may be driven by digital driving or analog driving. It is known that the analog driving may result in mura phenomenon due to Vth/μuniformity/reliability, and mura phenomenon may be greatly improved by the digital driving.

The gray level is determined by the time of emission in digital driving. A longer display time may result in a higher luminance, i.e., a greater gray-scale value. Thus, the gray-scale may be controlled by adjusting a light emitting period. A frame may be divided into several sub-frames, and each sub-frames corresponds to a time period. In this way, the light emitting period may be controlled by combining the sub-frames so as to show different grayscales.

However, the above method may results in display defects, which is called as pseudo contour." Usually, such defects may be cured by increasing a refresh rate, which shortens the time period corresponding to the sub-frame. But such solution consumes a great deal of energy.

The above solution may cure the pseudo contour issue, but raises the power consumption issue.

SUMMARY

The method of driving active-matrix organic light-emitting diode (AMOLED) panels may eliminate the pseudo contour issue of AMOLED panels without increasing the power consumption of the panels.

In one aspect, a method of driving active-matrix organic light-emitting diode (AMOLED) panels includes: (A) dividing a current frame of a current image corresponding to an i-th color component into a plurality of sub-frames, wherein $i \in [1,N]$, and N is a total number of the color component; (B) obtaining a sequence of the sub-frames of a previous frame of a previous image corresponding to the i-th color component, wherein the previous frame has been divided into a plurality of sub-frames by the same way with the current frame; (C) determining the sequence of the sub-frames of the current frame in accordance with the sequence of the sub-frames of the previous frame, wherein the sequence of the sub-frames (SF) of the current frame is same with or is different from that of the previous frame; and (D) controlling the panel to display in accordance with the sequence of the sub-frames of the current frame determined by corresponding color components.

Wherein the step (C) further includes: (C1) obtaining a first number of the i-th color component of the current image indicating a number of pixels having a first characteristic; (C2) obtaining a second number of the i-th color component of the current image indicating a number of pixels having a second characteristic; (C3) obtaining a third number of the i-th color component of the current image indicating a number of pixels having a third characteristic; (C4) obtaining a fourth number of the i-th color component of the current image indicating a number of pixels having a fourth characteristic; (C5) comparing a sum of the first number and the second number with the sum of the third number and the fourth number; and (C6) determining the sequence of the sub-frames of the current frame is the same with that of the sub-frames of the previous frame when the sum of the first number and the second number is not greater than the sum of the third number and the fourth number, and determining the sequence of the sub-frames of the current frame is different from with that of the sub-frames of the previous frame when the sum of the first number and the second number is greater than the sum of the third number and the fourth number.

The method further includes: (E) determining a lighting state of pixels of the i-th color component within each sub-frames in accordance with a grayscale value of the i-th color component of the pixel in the current frame.

Wherein the step (D) further includes: controlling the panel in accordance with the lighting state of the pixels of each color components within each sub-frames and the sequence of the sub-frames of the current frame of each color components.

Wherein time periods of each of the sub-frames are configured to be a geometric progression.

Wherein the step (C) further includes: determining the sequence of the sub-frames of the current frame is opposite to that of the previous frame when the sequence of the sub-frames of the current frame is different from that of the previous frame.

Wherein the first characteristic is determined when the grayscale value of the i-th color component is smaller than a first predetermined value, and the grayscale value of the i-th color component of the pixel located in the same location of the previous frame is the first predetermined value; the second characteristic is determined when the grayscale value of the i-th color component is the first predetermined value, and the grayscale value of the i-th color component of the pixel located in the same location of the previous frame is smaller than the first predetermined value; the third characteristic is determined when the grayscale value of the i-th color component is the first predetermined value, and the grayscale value of the i-th color component of the pixel located in the same location of the previous frame is the firsts predetermined value; the fourth characteristic is determined when the grayscale value of the i-th color component equals to a second predetermined value, and the grayscale value of the i-th color component of the pixel located in the same location of the previous frame is the second predetermined value.

Wherein when the grayscale value of the i-th color component equals to the first predetermined value, the pixel of the i-th color component is configured to be lighten in the latest sub-frame; when the grayscale value of the i-th color component equals to the second predetermined value, the pixel of the i-th color component is configured to be dark in the latest sub-frame.

Wherein when each of the color components of the images comprises M number of grayscale values, the first predetermined value equals to $2^{M-1}$, the second predetermined value equals to $2^{M-1}-1$, and M is an integer larger than one.

In view of the above, the pseudo contour issue of AMOLED panels may be greatly enhanced by controlling the sequence of the sub-frames of the current frame without increasing the power consumption of the panels.

DETAILED DESCRIPTION OF THE EMBODIMENTS

Figure 1:
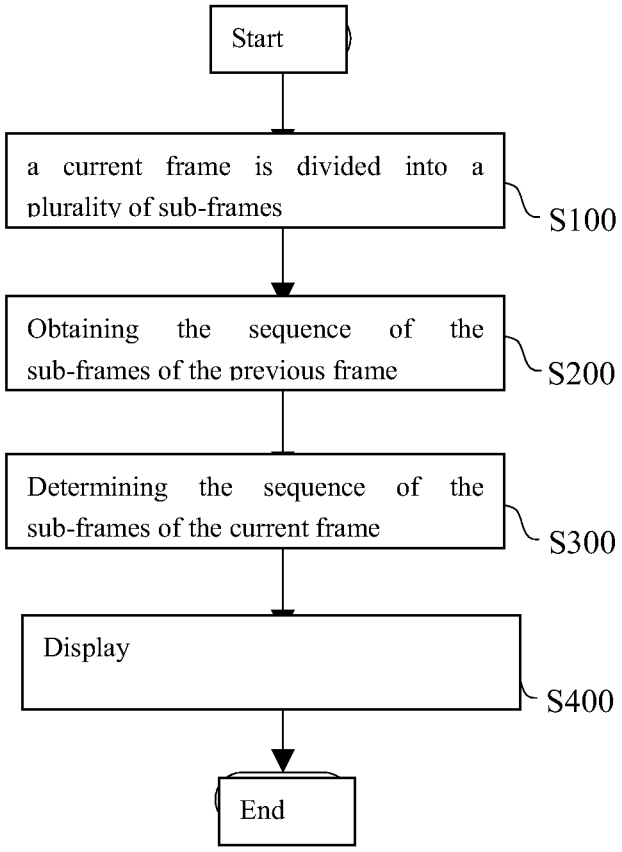
FIG. 1 is a flowchart of the driving method of AMOLED panels in accordance with one embodiment.

Embodiments of the invention will now be described more fully hereinafter with reference to the accompanying drawings, in which embodiments of the invention are shown.

Various example embodiments will now be described more fully with reference to the accompanying drawings in which some example embodiments are shown. In the drawings, the thicknesses of layers and regions may be exaggerated for clarity. In the following description, in order to avoid the known structure and/or function unnecessary detailed description of the concept of the invention result in confusion, well-known structures may be omitted and/or functions described in unnecessary detail.

According to the present disclosure, the driving method of the AMOLED may be implemented by corresponding devices or processes. For instance, the driving method may be conducted by a specific device or processes dedicated to the AMOLED panels.

FIG. 1 is a flowchart of the driving method of AMOLED panels in accordance with one embodiment.

In block S100, a current frame of a current image corresponding to an i-th color component is divided into a plurality of sub-frames (SF). The time periods of each of the sub-frames (SF) are different, wherein $i \in [1,N]$, i is a natural number, and N is a total number of the color components.

The current frame relates to a display time period of the current frame of video images. For instance, the time periods of the sub-frames may be configured to be a geometric progression.

For instance, pulse width modulation (PWM) may be adopted to control the AMOLED panels. According to the binary digits relationship, the current frame is divided into P number of sub-frames (SF) such that SF (j) relates to j-th binary digits. That is, SF(1) denotes that the time period of the sub-frame equals to one, and the time period of the sub-frame SF(j) equals to $2^{j-1}$. In addition, $$\sum_{j=1}^{P} 2^{j-1}$$

denotes the time period of the current frame, wherein P is an integer larger than one, and j is an integer. For instance, the current frame may be divided into eight sub-frames, including SF(1), SF(2), SF(3), SF(4), SF(5), SF(6), SF(7), and SF(8). As such, sub-frames (1) to (8) corresponds to the least significant bit (LSB) to the most significant bit (MSB) of binary digits.

For instance, after block S100, a lighting state of the i-th color component is determined in accordance with a grayscale value of the i-th color component of the pixel in the current frame. In this way, the light emitting period of the pixels may be configured to be different by combining the lighting or non-lighting sub-frames so as to display different grayscales of the i-th color component. In an example, the grayscale value of the i-th color component is represented by P number of binary bits. The current frame is divided into P number of sub-frames (SF) in accordance with the relationship of binary digits. When the binary bit of the i-th color component equals to one, the corresponding sub-frame is configured to be lighting. When the binary bit of the i-th color component equals to zero, the corresponding sub-frame is configured to be non-lighting. In the above example, there are totally 256 grayscales, i.e., grayscale 0 to 255, that can be represented by 8 sub-frames. For instance, under the condition that the current frame includes eight sub-frames, i.e., SF(1) to SF(8), and the desired grayscale value is 15, the i-th color component is configured to be lighting during SF(1), SF(2), SF(3), and SF(4) and the i-th color component is configured to be not lighting during SF(5), SF(6), SF(7), and SF(8).

In block S200, a sequence of the sub-frames of a previous frame of a previous image corresponding to the i-th color component is obtained, wherein the previous frame has been divided into a plurality of sub-frames (SF) by the same way with the current frame.

For instance, the previous frame is divided into eight sub-frames, including SF(1), SF(2), SF(3), SF(4), SF(5), SF(6), SF(7), and SF(8). The sequence of the sub-frames of the previous frame may be, but not limited to, from SF(1) to SF(8) or from SF(8) to SF(1). In an example, when the AMOLED panel has been driven by PWM, the sequence of the sub-frames of each images may be from SF(1) to SF(8).

In block S300, the sequence of the sub-frames (SF) of the current image is determined in accordance with the sequence of the sub-frames (SF) of the previous image. It is to be noted that the sequence of the sub-frames (SF) of the current image may be the same with or be different from that of the previous image.

The sequence of the sub-frames is determined in accordance with the corresponding color component, i.e., the value within [1, N] corresponding to i.

After the frame is divided into a plurality of sub-frames, all of the images are displayed by the AMOLED panel with the sub-frames having the same sequence, which results in pseudo contour issue.

Figure 2:
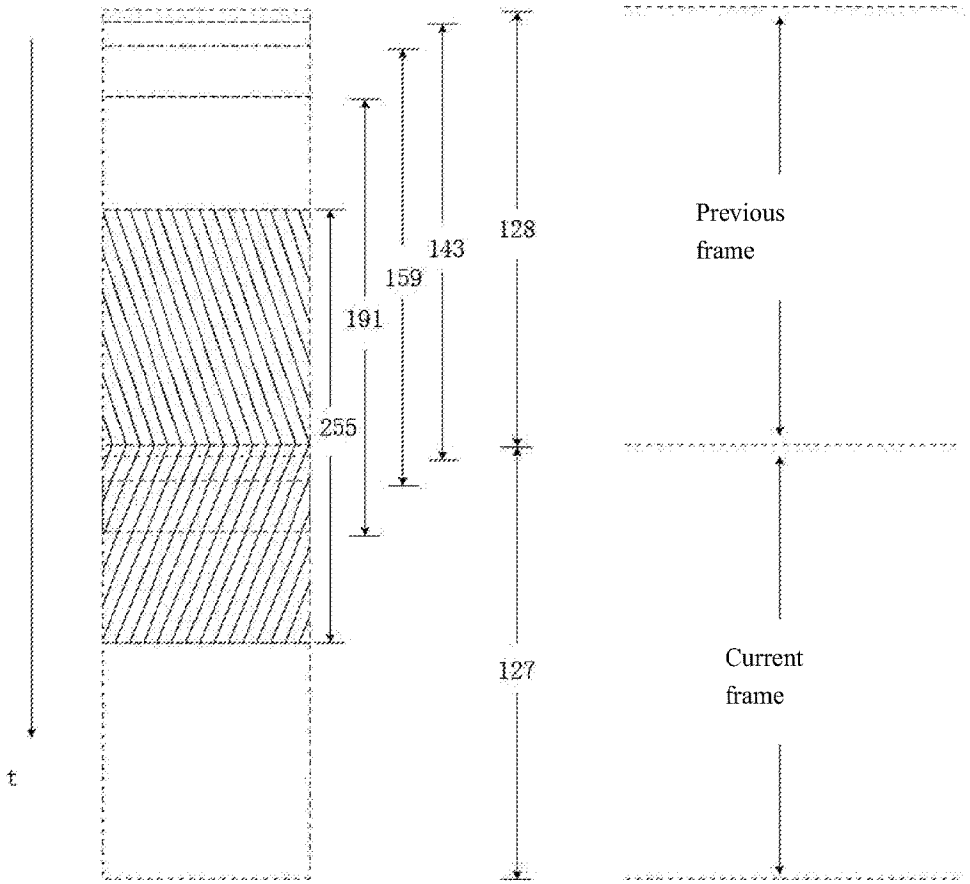
FIG. 2 is an example of the lighten pseudo contour.
Figure 2:
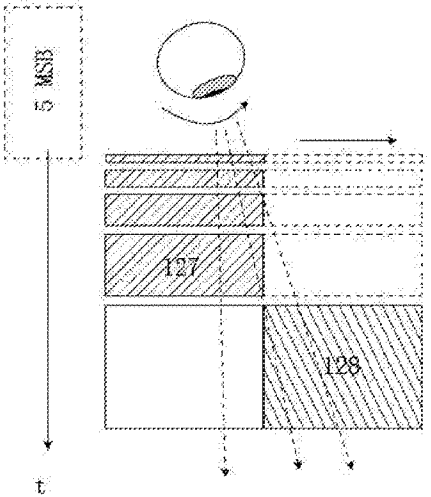
Figure 3:
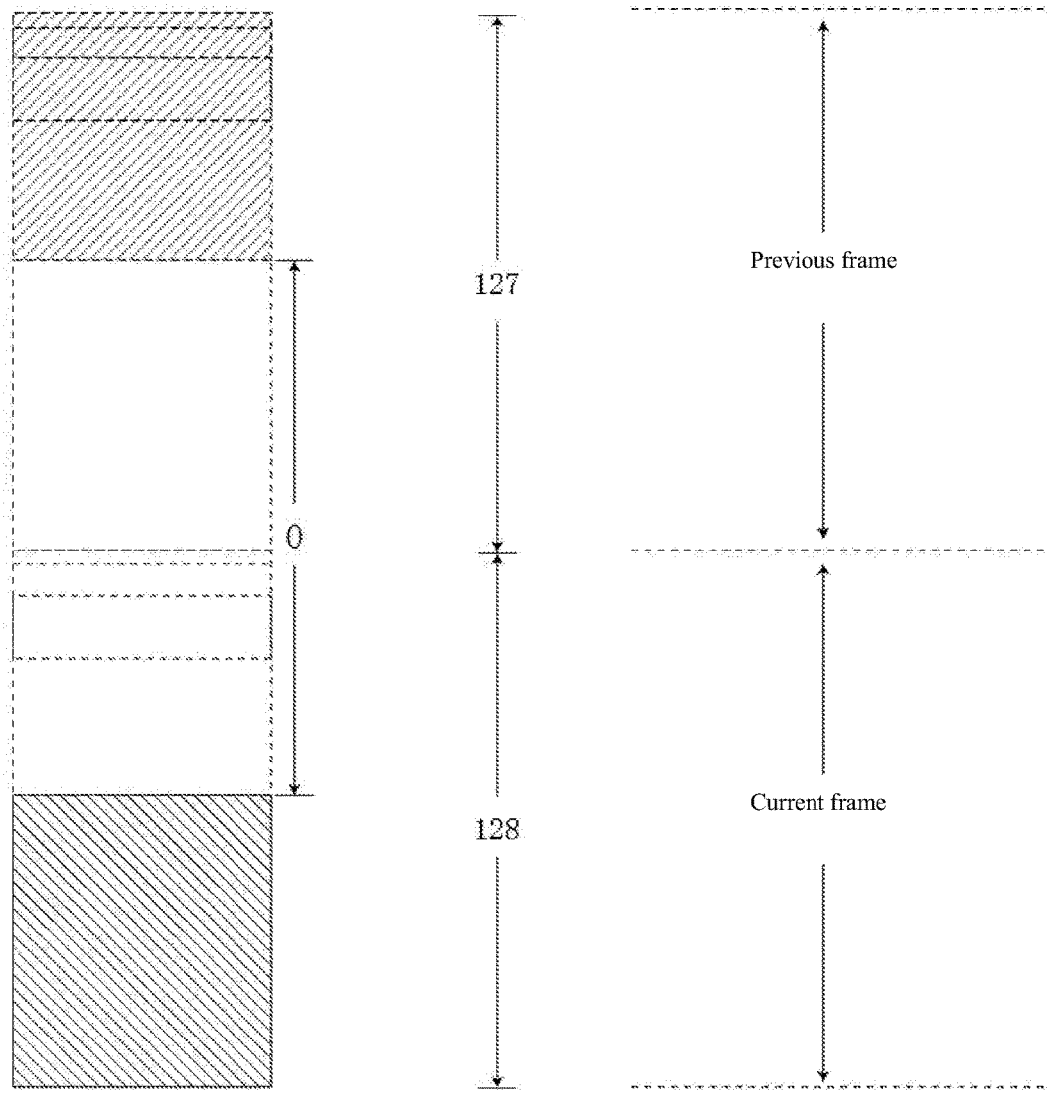
FIG. 3 is an example of the darken pseudo contour.

Referring to FIGS. 2 and 3, five MSB sub-frames, i.e., SF(4) to SF(8), are taken as an example to illustrate the lighten or darken pseudo contour effect when the sub-frames are arranged from SF(1) to SF(8).

FIG. 2 is an example of the lighten pseudo contour. As shown in FIG. 2, when the video image shifts rightward, the grayscale value of the i-th color component of a specific pixel in the previous frame is 128, and that of the pixel in the same location of the current frame is 127 (hereinafter referred to as "grayscale value 128 to 127"). Thus, the i-th color component of the specific pixel of the previous frame is configured to be dark within sub-frames SF(1) to SF(7). It is to be noted that, in FIG. 2, white color denotes that the i-th color component is dark, and slashes denote that the i-th color component is lighten up. In the sub-frame SF(8), the i-th color component of the specific pixel in the same location of the current frame is configured to be lighten within sub-frames SF(1) to SF(7) and is configured to be dark within sub-frame SF(8).

As the grayscale observed by users eyes usually is the result after integrating with respect to the light emitting period, with the increment of the time period (t), the following results are observed, such as the grayscale combination (143) including SF(5) to SF(8) of the previous frame and SF(1) to SF(4) of the current frame, the grayscale combination (159) including SF(6) to SF(8) of the previous frame and SF(1) to SF(5) of the current frame, the grayscale combination (191) including SF(7) to SF(8) of the previous frame and SF(1) to SF(6) of the current frame, and the grayscale combination (255) including SF(8) of the previous frame and SF(1) to SF(7) of the current frame. Similarly, the grayscale combination (191, 159, 143) through grayscale combination (127). Under the circumstance, the brightest pseudo contour (grayscale 255) is observed by users and thus the display performance is greatly affected.

FIG. 3 is an example of the darken pseudo contour. In this example, the grayscale value of the i-th color component of one specific pixel of the previous frame equals to 127, and the grayscale value of that of the pixel in the same location of the current frame equals to 128. The i-th color component of the specific pixel is configured to be lighting within the SF(1) through SF(7). As shown in FIG. 3, the white color denotes that the i-th color component is dark, and slashes denote that the i-th color component has been lightened up. The i-th color component of the specific pixel is configured to be dark within SF(8). The i-th color component of the pixel in the same location of the current frame is configured to be dark within SF(1) to SF(7), and is configured to be lightened up within SF(8). Thus, users' eyes may observe the grayscale combination (grayscale value equals to zero) including the SF(8) of the previous frame and the SF(1) to SF(7) of the current frame, and the darkening grayscale effect. Thus, under the circumstance, the darkest pseudo contour (grayscale 0) is observed by users and thus the display performance is greatly affected.

In order to enhance the pseudo contour defects as shown in FIGS. 2 and 3, the sequence of the sub-frames of the current frame may be controlled in accordance with that of the previous frame such that the sequence of the sub-frames of the current frame is the same with or is different from that of the previous frame. In an example, when the sequence of the sub-frames of the current frame is different from that of the previous frame, the sequence of the sub-frames of the current frame is determined to be opposite to that of the previous frame.

Figure 4:
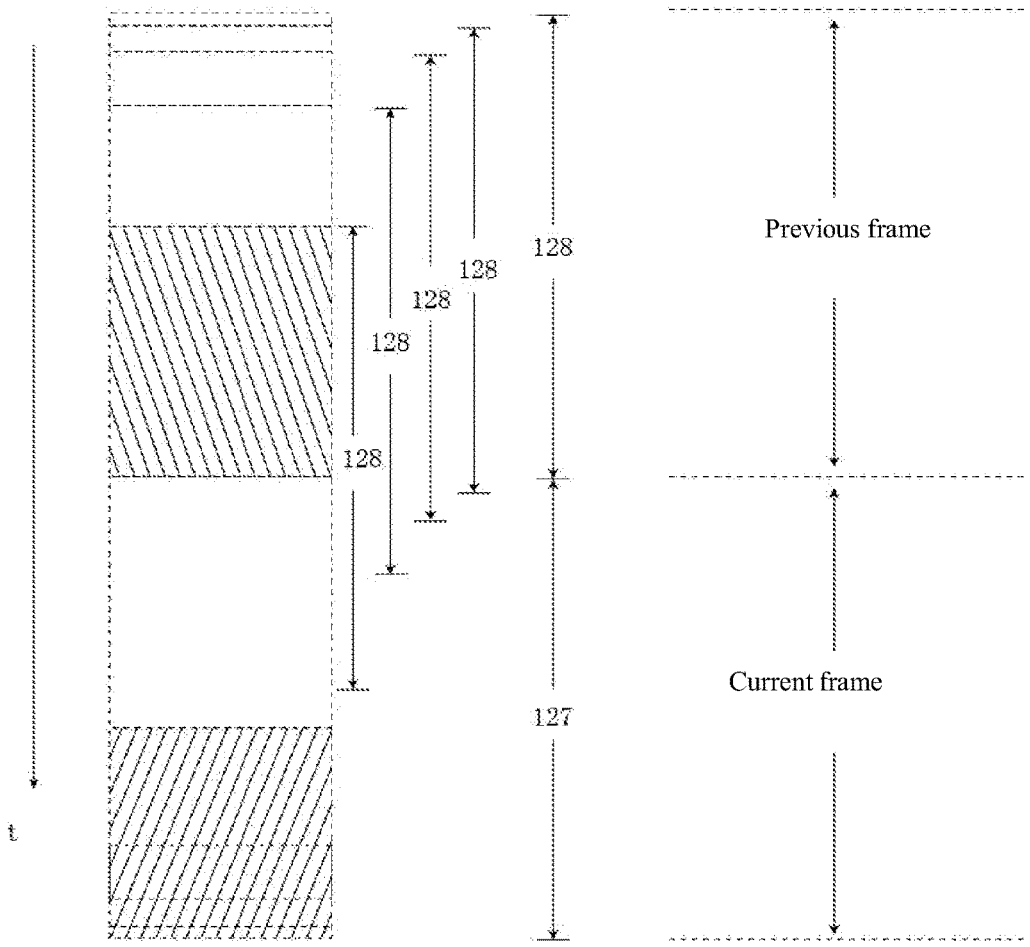
FIG. 4 shows an example in which the sequence of the current sub-frames of the current frame is opposite to that of the previous frame.

FIG. 4 shows an example in which the sequence of the current sub-frames of the current frame is opposite to that of the previous frame.

As shown in FIG. 4, when the lighten pseudo contour in FIG. 2 occurs, the sequence of the current sub-frames is configured to be opposite to that of the previous frame. In FIG. 4, t denotes time, the white color denotes that the i-th color component is dark, and slashes denote that the i-th color component is lightened up. As such, under the conditions where the grayscale value is transited from 128 to 127, the phenomenon in which the grayscale value equals to 255 does not happen, which greatly eliminate the lighten pseudo contour.

Similarly, the darken pseudo contour, as shown in FIG. 3, may be eliminated by inversing the sequence of the sub-frames of the previous frame.

Figure 5:
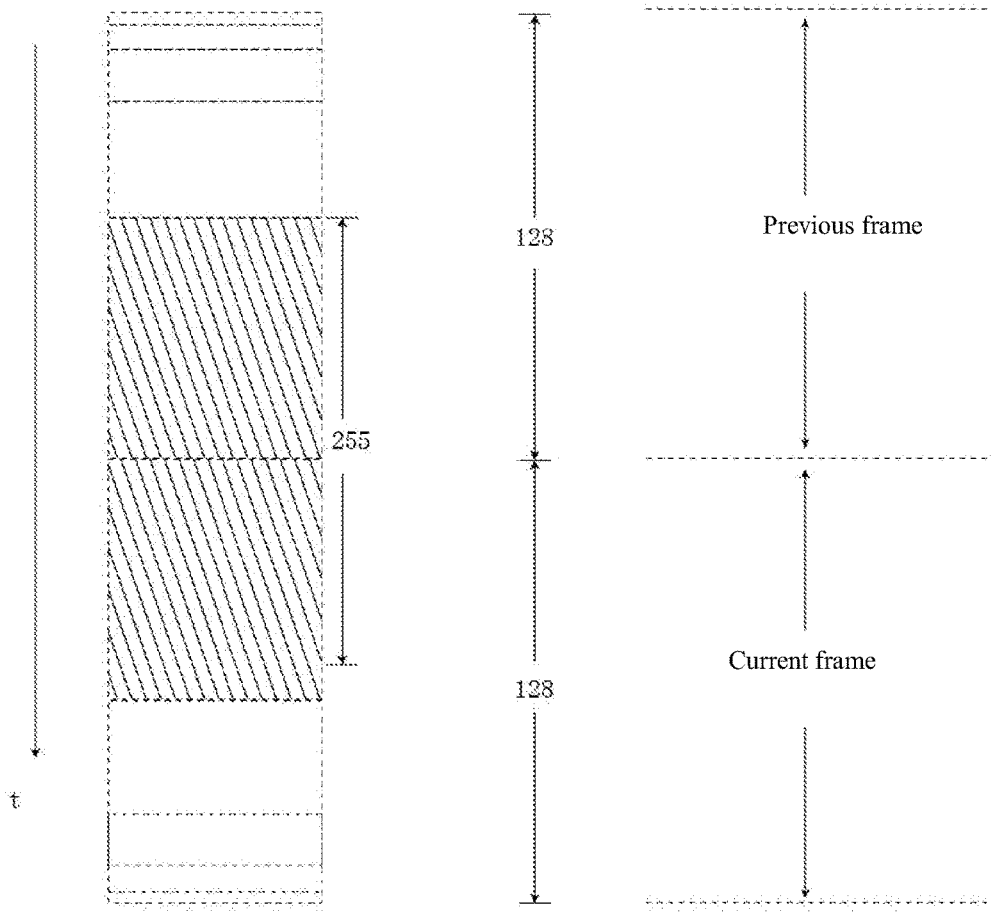
FIG. 5 is an example showing the lighten pseudo contour in accordance with one embodiment.

However, new pseudo contours may occur when adopting the method shown in FIG. 4. For instance, the lighten pseudo contour (grayscale 255) may occur when the i-th color component of the pixel of the current frame equals to 128 and when the i-th color component of the pixel in the same location of the previous frame equals to 128. As shown in FIG. 5, t denotes time, the white color denotes that the i-th color component is dark, and slashes denote that the i-th color component is lightened up. The darken pseudo contour (grayscale 0) may occur when the i-th color component of the pixel of the current frame equals to 127 and when the i-th color component of the pixel in the same location of the previous frame equals to 127.

Figure 6:
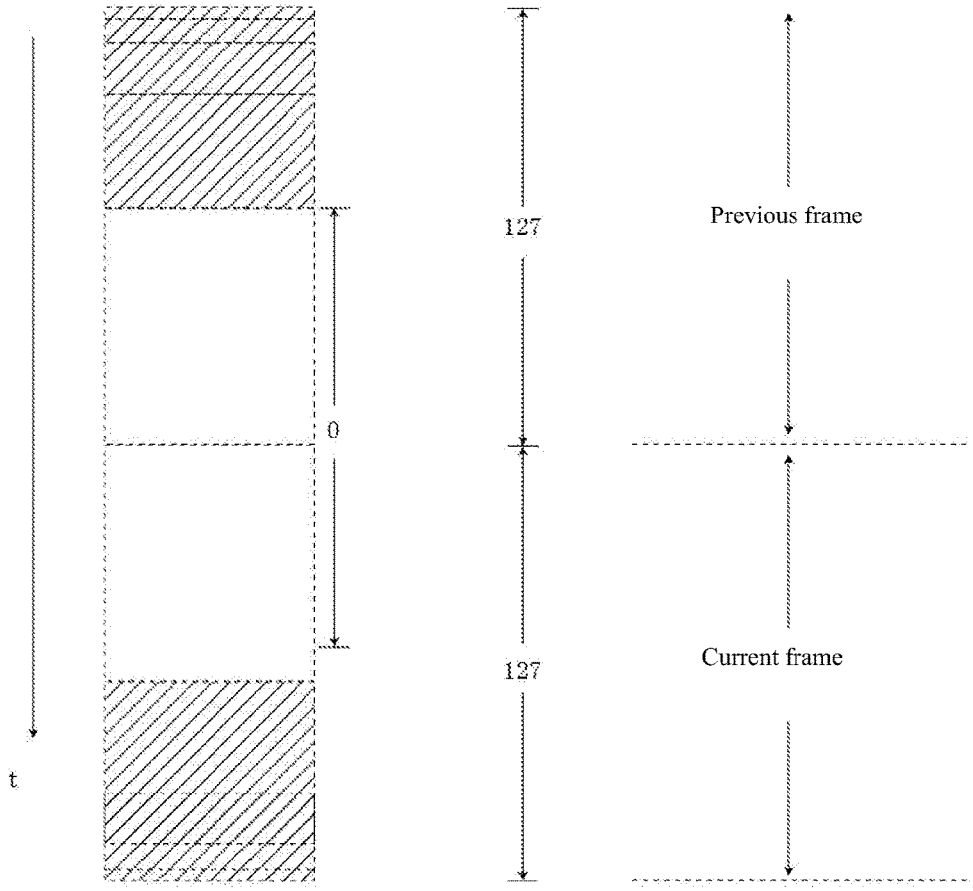
FIG. 6 is an example showing the darken pseudo contour in accordance with one embodiment.

As shown in FIG. 6, t denotes time, the white color denotes that the i-th color component is dark, and slashes denote that the i-th color component is lightened up. Thus, in order to reach balance between the original pseudo contour and the new pseudo contour to obtain a better display performance, whether the sequence of the sub-frames of the current frame has to be configured to be opposite to that of the previous frame can be determined in accordance with the number of the original pseudo contour and the new pseudo contour.

Figure 7:
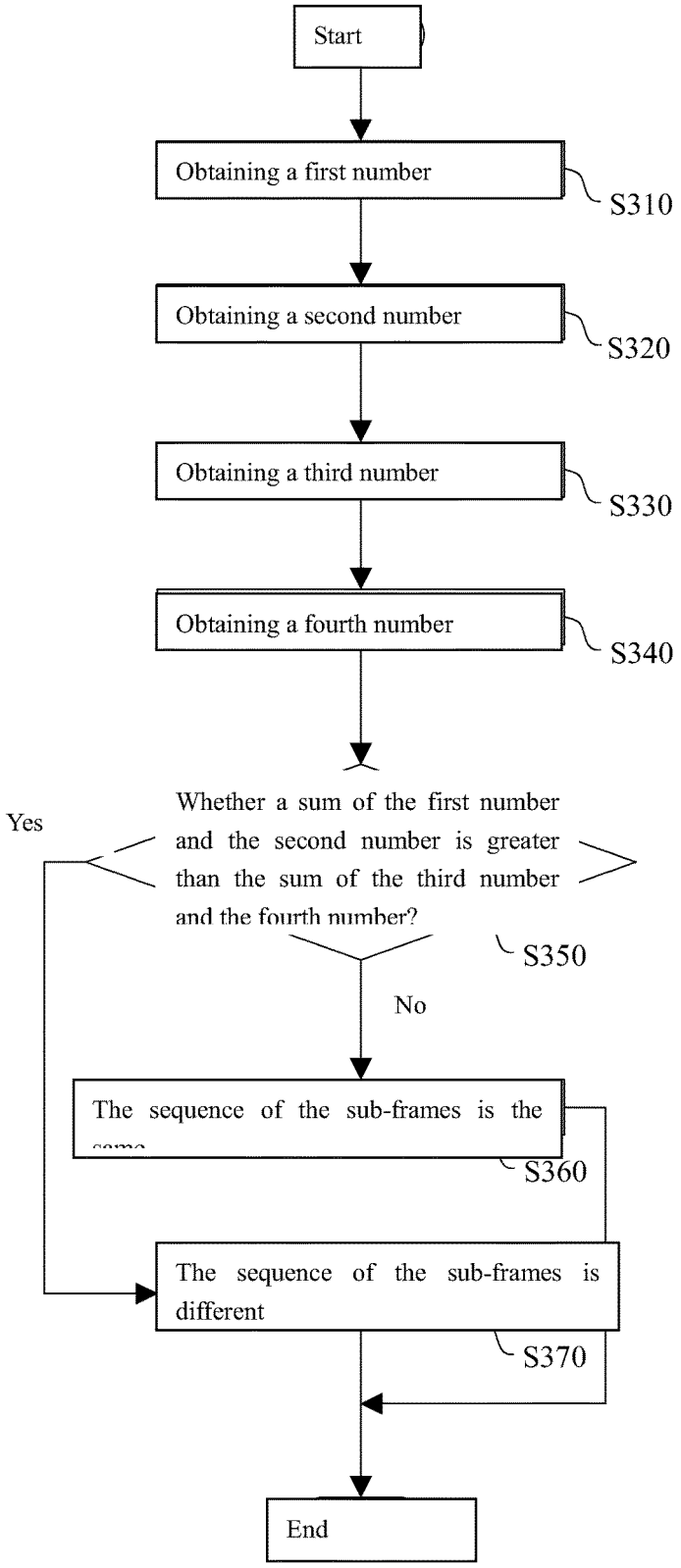
FIG. 7 is a flowchart illustrating the method of determining the sequence of the current sub-frames in accordance with one embodiment.

FIG. 7 is a flowchart illustrating the method of determining the sequence of the current sub-frames in accordance with one embodiment.

In block S310, a first number of the i-th color component of the current image indicating a number of pixels having a first characteristic is obtained. The first characteristic is indicative of that the sequence of the sub-frames (SF) of the current frame is the same with that of the previous frame (hereinafter referred to as "same sequence"). The first characteristic may result in that the lighten pseudo contour occurs in the i-th color component. In an example, the first characteristic may indicate that the grayscale value of the i-th color component is smaller than a first predetermined value, which is the grayscale value of the i-th color component of the pixel in the same location in the previous frame.

In an embodiment, when the grayscale value of the i-th color component equals to the first predetermined value, the pixel of the i-th color component is configured to be lighten in the latest sub-frame and is configured to be dark in the earliest sub-frame. Preferably, when the grayscale value of the i-th color component equals to the first predetermined value, the pixel of the i-th color component is configured to be lighten only in the latest sub-frame. In an example, the divided sub-frames correspond to binary digits, i.e., the grayscale is represented by binary digits. When the i-th color component is configured to be lighten up only in the latest sub-frame, the binary digit corresponding to the latest sub-frame is represented as one, and the binary digits corresponding to other sub-frames are represented as zero. In an example, when each of the color components of the images comprises M number of grayscale values, the first predetermined value equals to $2^{M-1}$, the second predetermined value equals to $2^{M-1}-1$, and M is an integer larger than one. In an example, the first predetermined value equals to 128. Under the circumstance, the grayscale value of the i-th color component of the specific pixel of the previous frame is 128. When the grayscale value of the i-th color component of the pixel in the same location of the previous frame is less than 128, i.e., 127, 63, and 31, the lighten pseudo contour may occur.

When the grayscale value of the i-th color component of the specific pixel of the previous frame is 128 and the grayscale value of the i-th color component of the pixel in the same location of the previous frame equals to 127, the brightest pseudo contour (grayscale 255) may occur. Thus, the first number relates to the number of the pixels having the lighten pseudo contour when the sequences are the same.

In block S320, a second number of the i-th color component of the current image indicating a number of pixels having a second characteristic is obtained.

The second characteristic relates to the scenario in which the i-th color component includes the darken pseudo contour where the sequences are the same. In addition, the grayscale value of the i-th color component of the pixel in the same location of the previous frame is smaller than the first predetermined value. When the grayscale value of the i-th color component of the pixel in the same location of the previous frame is less than 128, i.e., 127, 63, or 31, the darken pseudo contour may occur when the grayscale value of the i-th color component of the pixel in the same location of the current frame is 128. Thus, the second number relates to the number of the pixels having the darken pseudo contour when the sequences are the same.

In block S330, a third number of the i-th color component of the current image indicating a number of pixels having a third characteristic is obtained.

The third characteristic relates to the scenario in which the i-th color component includes the darken pseudo contour where the sequences of the sub-frames of the current frame is different from that of the previous one (hereinafter referred to as "the sequences are different"). In addition, the grayscale value of the i-th color component of the pixel in the same location of the previous frame equals to the first predetermined value. Thus, the third number relates to the number of the pixels having the lighten pseudo contour when the sequences are different.

In block S340, a fourth number of the i-th color component of the current image indicating a number of pixels having a fourth characteristic is obtained.

The fourth characteristic relates to the scenario in which the i-th color component includes the darken pseudo contour where the sequences are different. In an example, the fourth characteristic is determined when the grayscale value of the i-th color component equals to a second predetermined value, and the grayscale value of the i-th color component of the pixel located in the same location of the previous frame is the second predetermined value.

In an embodiment, when the grayscale value of the i-th color component equals to the second predetermined value, the pixel of the i-th color component is configured to be dark in the latest sub-frame. In an example, when the grayscale value of the i-th color component equals to the second predetermined value, the pixel of the i-th color component is configured to be dark only in the latest sub-frame.

The i-th color component of the pixel is configured to only be dark in the latest sub-frame. For instance, the divided sub-frames correspond to binary digits, i.e., the grayscale is represented by binary digits. When the i-th color component is configured to be lighten up only in the latest sub-frame, the binary digit corresponding to the latest sub-frame is represented as zero, and the binary digits corresponding to other sub-frames are represented as one. In an example, when each of the color components of the images comprises M number of grayscale values, the first predetermined value equals to $2^{M-1}$, the second predetermined value equals to $2^{M-1}-1$, and M is an integer larger than one. In an example, the second predetermined value equals to 127. Thus, the fourth number relates to the number of the pixels having the darken pseudo contour when the sequences are different.

In block S350, a sum of the first number and the second number is compared with the sum of the third number and the fourth number. In other words, the numbers of pseudo contours with the same sequence and without the same sequence, including lighten and darken pseudo contours, are compared. Afterward, the sequence of the sub-frames of the current frame is controlled in accordance with the comparing result.

When the sum of the first number and the second number is not greater than the sum of the third number and the fourth number, in block S360, the sequence of the sub-frames of the current frame is determined to be the same with that of the sub-frames of the previous frame. That is, when the number of the pseudo contours with the same sequence is not greater than that under the condition that the sequence is different, the sequence of the sub-frames of the current frame is determined to be the same with that of the previous frame.

When the sum of the first number and the second number is greater than the sum of the third number and the fourth number, in block S370, the sequence of the sub-frames of the current frame is determined to be different from with that of the sub-frames of the previous frame. That is, when the number of the pseudo contours with the same sequence is greater than that under the condition that the sequence is different, the sequence of the sub-frames of the current frame is determined to be different from that of the previous frame.

It can be understood that the blocks S310 to S340 in FIG. 7 may be executed other than the sequence in FIG. 7. For instance, the blocks may be executed in a sequence like, S320, S330, S310, and S340.

Referring to FIG. 1, in block S400, the panel is controlled in accordance with the sequence of the sub-frames of the current frame corresponding to each color components.

After determining the sequence of the sub-frames of the current frame corresponding to each color components, i.e., the value within [1, N] corresponding to the i, the AMOLED may be controlled by the determined sequence. In an example, the panel has been controlled in accordance with the lighting state of the pixels of each color components within each sub-frames and the sequence of the sub-frames of the current frame of each color components.

In view of the above, the pseudo contour issue of AMOLED panels may be greatly enhanced by controlling the sequence of the sub-frames of the current frame without increasing the power consumption of the panels.

It should be noted that the relational terms herein, such as "first" and "second", are used only for differentiating one entity or operation, from another entity or operation, which, however do not necessarily require or imply that there should be any real relationship or sequence. Moreover, the terms "comprise", "include" or any other variations thereof are meant to cover non-exclusive including, so that the process, method, article or device comprising a series of elements do not only comprise those elements, but also comprise other elements that are not explicitly listed or also comprise the inherent elements of the process, method, article or device. In the case that there are no more restrictions, an element qualified by the statement "comprises a . . . " does not exclude the presence of additional identical elements in the process, method, article or device that comprises the said element.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A method of driving active-matrix organic light-emitting diode (AMOLED) panels, comprising:

(A) dividing a current frame of a current image corresponding to an i-th color component into a plurality of sub-frames, wherein i∈[1, N], and N is a total number of the color component;

(B) obtaining a sequence of the sub-frames of a previous frame of a previous image corresponding to the i-th color component, wherein the previous frame has been divided into a plurality of sub-frames by the same way with the current frame;

(C) determining the sequence of the sub-frames of the current frame in accordance with the sequence of the sub-frames of the previous frame, wherein the sequence of the sub-frames (SF) of the current frame is same with or is different from that of the previous frame;

the step (C) further comprising:

(C1) obtaining a first number of the i-th color component of the current image indicating a number of pixels having a first characteristic, the first characteristic is determined when the grayscale value of the i-th color component is smaller than a first predetermined value, and the grayscale value of the i-th color component of the pixel located in the same location of the previous frame is the first predetermined value;

(C2) obtaining a second number of the i-th color component of the current image indicating a number of pixels having a second characteristic, the second characteristic is determined when the grayscale value of the i-th color component is the first predetermined value, and the grayscale value of the i-th color component of the pixel located in the same location of the previous frame is smaller than the first predetermined value;

(C3) obtaining a third number of the i-th color component of the current image indicating a number of pixels having a third characteristic, the third characteristic is determined when the grayscale value of the i-th color component is the first predetermined value, and the grayscale value of the i-th color component of the pixel located in the same location of the previous frame is the first predetermined value;

(C4) obtaining a fourth number of the i-th color component of the current image indicating a number of pixels having a fourth characteristic, the fourth characteristic is determined when the grayscale value of the i-th color component equals to a second predetermined value, and the grayscale value of the i-th color component of the pixel located in the same location of the previous frame is the second predetermined value;

(C5) comparing a sum of the first number and the second number with the sum of the third number and the fourth number; and (C6) determining the sequence of the sub-frames of the current frame is the same with that of the sub-frames of the previous frame when the sum of the first number and the second number is not greater than the sum of the third number and the fourth number, and determining the sequence of the sub-frames of the current frame is different from with that of the sub-frames of the previous frame when the sum of the first number and the second number is greater than the sum of the third number and the fourth number; and (D) controlling the panel to display in accordance with the sequence of the sub-frames of the current frame determined by corresponding color components; and (E) determining a lighting state of pixels of the i-th color component within each sub-frames in accordance with a grayscale value of the i-th color component of the pixel in the current frame.

2. The method as claimed in claim 1, wherein the step (D) further comprises:

controlling the panel in accordance with the lighting state of the pixels of each color components within each sub-frames and the sequence of the sub-frames of the current frame of each color components.

3. The method as claimed in claim 1, wherein time periods of each of the sub-frames are configured to be a geometric progression.

4. The method as claimed in claim 1, wherein the step (C) further comprises:

determining the sequence of the sub-frames of the current frame is opposite to that of the previous frame when the sequence of the sub-frames of the current frame is different from that of the previous frame.

5. The method as claimed in claim 1, wherein:

when the grayscale value of the i-th color component equals to the first predetermined value, the pixel of the i-th color component is configured to be lighten in the latest sub-frame;

when the grayscale value of the i-th color component equals to the second predetermined value, the pixel of the i-th color component is configured to be dark in the latest sub-frame.

6. The method as claimed in claim 5, wherein when each of the color components of the images comprises M number of grayscale values, the first predetermined value equals to $2^{M-1}$, the second predetermined value equals to $2^{M-1}-1$, and M is an integer larger than one.

* * * * *